US007942979B2

(12) United States Patent
Boockmann

(10) Patent No.: US 7,942,979 B2
(45) Date of Patent: May 17, 2011

(54) PROCESS AND APPARATUS FOR CLEANING WIRES OR THE OUTER SURFACE OF A TUBE

(75) Inventor: Gerhard Boockmann, Niederlauer (DE)

(73) Assignee: Boockmann GmbH, Niederlauer (DE)

( * ) Notice: Subject to any disclaimer, the term of this patent is extended or adjusted under 35 U.S.C. 154(b) by 1259 days.

(21) Appl. No.: 11/499,410

(22) Filed: Aug. 4, 2006

(65) Prior Publication Data

US 2007/0056607 A1 Mar. 15, 2007

(30) Foreign Application Priority Data

Aug. 6, 2005 (DE) ..... 10 2005 037 159

(51) Int. Cl.
*B08B 1/02* (2006.01)

(52) U.S. Cl. ..... 134/15; 15/256.6

(58) Field of Classification Search ..... 15/97.1, 15/102, 256.5, 256.6; 134/15
See application file for complete search history.

(56) References Cited

U.S. PATENT DOCUMENTS

| | | | | |
|---|---|---|---|---|
| 2,305,755 A | | 12/1942 | Akahira | |
| 4,817,645 A | | 4/1989 | Vogel | |
| 5,382,455 A | * | 1/1995 | Boockmann | 427/429 |
| 5,409,535 A | * | 4/1995 | Boockmann | 118/234 |
| 5,438,725 A | * | 8/1995 | Okada et al. | 15/97.1 |

FOREIGN PATENT DOCUMENTS

| | | |
|---|---|---|
| DE | 4134070 | 8/1992 |
| DE | 10001591 | 7/2001 |

* cited by examiner

*Primary Examiner* — Randall Chin
(74) *Attorney, Agent, or Firm* — Michael L. Dunn

(57) ABSTRACT

A process for cleaning a wire or the outer surface of a tube using one or more textile or textile-like material strands that runs substantially parallel, but opposite, to the direction of travel of the wire or tube, that may contain at least one cleaning material, and that are arranged to run in the form of at least one loop lying on the wire or tube, characterized in that the speed and the tension of the textile or textile-like material strand is adjusted and regulated. The device of the invention is device for practicing the method for cleaning a wire or the outer surface of a tube, using textile or textile-like material strands which move substantially parallel to, and against, the direction of travel of the wire or tube, the textile or textile-like material strands surrounding the wire or tube in the form of at least one loop lying close thereto in a looping zone and optionally containing cleaning material, wherein the approach and exit angle of one or more of said material strands is flat with respect to the wire or the outer surface of the tube, characterized by at least one apparatus for adjusting and regulating the speed and the tension of the material strands. Such a device or process wherein the speed and the tension of the material strands can be adjusted keeps the approach and exit angle of the material strand with respect to the wire or the outer surface of the tube low. This prevents the material strand from tightening and tearing.

32 Claims, 1 Drawing Sheet

PROCESS AND APPARATUS FOR CLEANING WIRES OR THE OUTER SURFACE OF A TUBE

BACKGROUND OF THE INVENTION

The invention relates to a device for cleaning a wire or the outer surface of a tube, both preferably with a rounded cross section, using textile or textile-like material strands which move substantially parallel to and against the direction of travel of the wire or tube, the textile or textile-like material strands surrounding the wire or tube in the form of at least one loop lying close thereto in a looping zone and optionally containing cleaning material, wherein the approach and exit angles of said material strands are flat with respect to the wire or the outer surface of the tube. When a plurality of loops is present, it can be said to lie in a spiral manner.

In the 1990s, a promising principle was established whereby a wire surface could be treated using a textile or textile-like material strand looped around the wire. As an example, European patent EP-B-0 499 775, claiming priority dates of 18.02.1991 and 15.10.1991, disclosed a method for lubricating a wire by coating the wire with a solid or liquid lubricant, wherein at least one loop lying close to the wire and soaked with at least one lubricating absorbent material strand was fed to the wire at a substantially constant rate which was lower than the feed rate of the wire. The wire and material strand were fed in the same direction.

That technology was not only used to evenly apply a solid or liquid substance such as paraffin to lubricate the wire, but was also used to clean wire surfaces, as in the apparatus described in German patent DE-A-100 01 591 and in United States patent U.S. Pat. No. 4,817,645.

When using that process to clean in counter-fed mode, the material strand frequently seizes and, as a result, rips. Apart from the resulting reduction in product quality, bringing the process back on-line after the material strand tears requires effort, leading to down time, which is deleterious to production.

BRIEF DESCRIPTION OF THE INVENTION

The aim of the invention is to overcome the disadvantages of the process known from U.S. Pat. No. 4,817,645 or at least to substantially reduce them and to prevent the textile or textile-like material strands from tearing.

This aim is achieved by the process of the invention and an appropriate device for carrying out the process. The solution to the problem lies in the fact that, in an apparatus with the features given above, at least one apparatus is provided for adjusting and regulating the speed and the tension of the material strands. The process of the invention is thus characterized in that the speed and the tension of the textile or textile-like material strands are adjusted and regulated.

More particularly, the process of the invention is a process for cleaning a wire or the outer surface of a tube using one or more textile or textile-like material strands that runs substantially parallel, but opposite, to the direction of travel of the wire or tube, that may contain at least one cleaning material, and that are arranged to run in the form of at least one loop lying on the wire or tube, characterized in that the speed and the tension of the textile or textile-like material strand is adjusted and regulated.

Again, more particularly, the device of the invention is device for cleaning a wire or the outer surface of a tube, using textile or textile-like material strands which move substantially parallel to, and against, the direction of travel of the wire or tube, the textile or textile-like material strands surrounding the wire or tube in the form of at least one loop lying close thereto in a looping zone and optionally containing cleaning material, wherein the approach and exit angle of one or more of said material strands is flat with respect to the wire or the outer surface of the tube, characterized by at least one apparatus for adjusting and regulating the speed and the tension of the material strands.

Such a device or process wherein the speed and the tension of the material strands can be adjusted keeps the approach and exit angle of the material strand with respect to the wire or the outer surface of the tube low. This prevents the material strand from tightening and tearing.

BRIEF DESCRIPTION OF THE DRAWING

The drawing shows a process of the invention depicted as a flow diagram. It shows the path of a textile strand and wire as a flow chart.

DETAILED DESCRIPTION OF THE INVENTION

Figure 1:
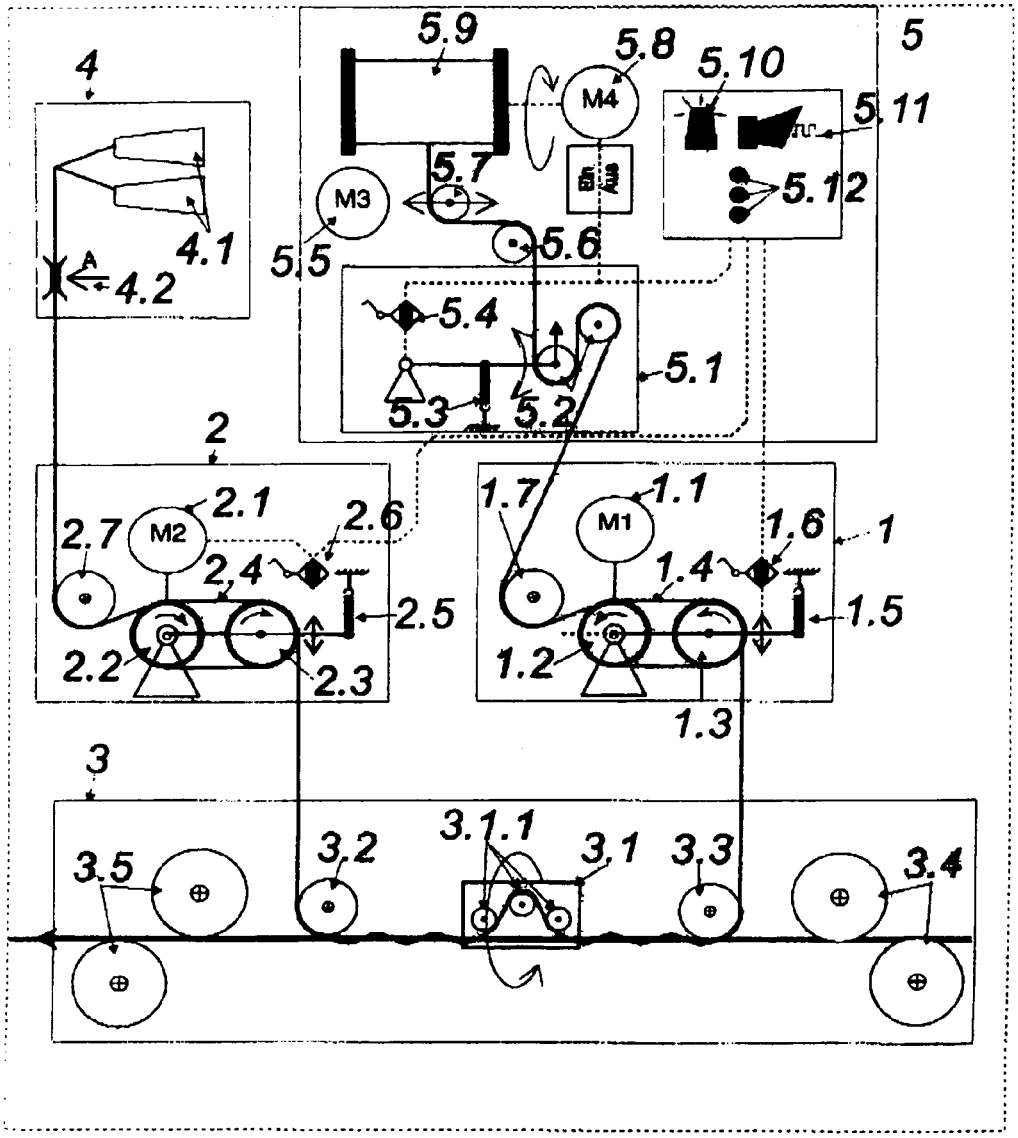

In the context of the present invention, the term "textile or textile-like material strand" has the broadest possible meaning as construed by the skilled person. The term "textile or textile-like material strand" means threads, yarns, strips and flat strips. The term "textile or textile-like material strand" also encompasses braided, woven, worked, knitted, crocheted, twisted and other material strands obtained by textile production processes, although these terms can be more narrowly described as textiles such as monofilaments, multifilaments with short or endless fibres produced by textile production processes. Preferred textile or textile-like material strands for use in the present invention are braided material strands, more particularly plaited, square, round, strip and flat braided strands. Braided material strands have the advantage that a shredded individual strand of a material strand braided from a plurality of individual strands is blocked as it crosses other individual strands, and thus the individual strand does not fray out, as would be the case with string or woven materials, and the whole material strand does not unravel, as would be the case with crocheted or knitted material strands. Strip braided and flat braided, i.e. braided flat strips, are particularly preferred material strands. These have the advantage that they run particularly smoothly in the process of the invention, and have a large contact surface between the textile or textile-like material strand and the wire or the outer surface of the tube, and are particularly suitable for large diameter wires or tubes.

In a preferred implementation of the invention, the textile or textile-like material strands are strip braids or flat braids formed from 3 to 51 individual strands. In an alternative preferred implementation of the invention, the textile or textile-like material strands are square braids or round braids formed from 4 to 32 individual strands.

The textile or textile-like material strands used in accordance with the invention are strip braids or flat braids, preferably with a width of 0.5 to 50 mm, more preferably 2 to 30 mm. Preferably, the square braids or round braids as used in the invention have a strand diameter of 0.5 to 30 mm, particularly preferably 1 to 10 mm.

The thicker the wire or tube to be cleaned, the stronger must be the textile strands employed. Preferably, wires or tubes with a diameter of more than 10 mm use strip braids, while those with a diameter of less than about 1 mm use round or square braids.

In a further preferred embodiment of the invention, the textile or textile-like material strands are square braids or round braids provided with a core arranged in the longitudinal direction of the strand, centrally of the web, the core being produced from a material which differs from that used to produce the individual strands of the web. The core absorbs tensional forces. When producing braids in the braiding machine, the core does not run with the individual strands to be braided and is thus not braided in, but is braided around parallel to the weft direction and thus can take up tensional forces without stretching.

Similar strengthening can be achieved in round, square and strip or flat braids by adding warp threads. These do not run centrally in the braiding machine, but in the centre of the impellers. Thus, they are not braided into the entire braided surface, but are braided around it, orientated in the weft direction. These production techniques with warp threads are familiar to the skilled person.

The term "textile or textile-like material strands" encompasses all substances which are suitable for the particular purpose, which are known to the skilled person or can be determined from the literature, such as handbooks. The term "textile-like material strands" thus also encompasses natural fibres, polymer fibres, metallic fibres, glass fibres, ceramic fibres, staple fibres (short fibres), plastic sheet and similar materials, which are bound with binders, which have the required properties for the purpose, such as tear resistance, fray resistance, absorbency, flock formation and other properties. Knowing the required properties and the properties of particular materials or combinations of materials, the skilled person will be able to produce or obtain materials suitable for the material strands used in accordance with the invention.

In a preferred embodiment of the invention, the textile or textile-like material strand is produced from a combination of individual strands of various materials or substances. The various substances for the individual strands are preferably selected so that the overall material strand is a combination of advantageous properties. As an example, aramide filament fibres to increase the tensile strength and fray resistance may advantageous be combined with textured filaments of polyamide or with twisted viscose fibres for enhanced absorbency.

The choice of material depends on the purpose of the process, as in some cases the material strands must be absorbent or porous in order to take up a liquid or solid substance such as a lubricant, polish, abrasive or cleaning material, to place it on the wire or tube in the looping zone. In other cases, the substance of the material strand may itself have the desired properties and thus does not need to be porous in order, for example, to take up and bind an abrasive substance.

The term "looping zone" as used here means a region in which single or multiple looping of the wire or tube by the material strand starts and ends, and thus is the zone in which the desired cleaning is carried out to completion. In order to support the cleaning effect, the material strand may contain a cleaning material in the form of a solvent and/or an abrasive or polish or other auxiliary materials. As mentioned above, the material strand may itself constitute the cleaning material, which usually acts abrasively to have an abrasive or polishing effect on the wire or tube surface to be cleaned and may wipe off and/or absorb liquid contaminants or loosely bound powder. FIG. 1 shows the looping zone between the payoff (filament payoff roll) 3.2 and the pickup (filament pick up roll) 3.3. To clean a wire or tube, finally, loops formed from at least one material strand lies close around the wire or tube and run in the opposite direction to the forward motion of the wire or tube. However, the description that the textile or textile-like material strand runs in a particular direction substantially parallel to the wire or tube does not means that every part, but rather the overall direction runs parallel thereto, as because of the looping, small individual sections of the material strand cannot run parallel to the wire or the tube.

Further, in connection with this invention, frictional force must be discussed. This is the force which arises by mutual friction in the looping zone because the textile or textile-like material is lying against the wire or outer surface of a tube to be cleaned. The frictional force clearly depends on the properties of the materials, but also on the amount of pressure with which the flexible material strand bears on the wire or tube. Preferably, the frictional force is the difference in the strand tension of the textile or textile material strand before and after the looping zone, i.e. in the FIGURE, at points 3.2 and 3.3.

The device of the invention preferably has such apparatus for adjusting and regulating the speed and the tension of the textile or textile material strand so that the speed and the tension of the textile or textile material strands can be substantially independently adjusted and regulated. Preferably, said independent adjustment and regulation of the speed and the tension is carried out in such a manner that both parameters are substantially constant. This adjustment and regulation of the tension of the material strand is preferably carried out on the strand feed-in side of the looping zone, while the apparatus for adjusting and regulating the speed of the textile or textile material strand is located on the strand take-up side of the looping zone.

Adjustment and regulation can be carried out manually, but it is preferably carried out automatically and for each of the independently adjustable and regulatable parameters, a reference value is provided which the actual value attempts to match when deviations occur. Adjustment and regulation of the tension of the material strand is preferably carried out with a motor with a high braking torque, preferably with a permanent-magnet synchronous motor.

Similarly, the speed of the material strand is adjusted and regulated with at least one motor with a high torque, preferably a permanent-magnet synchronous motor.

For a constant number of loops, increasing the tension in the strand increases the friction, while reducing the tension in the strand reduces the friction. The friction is adjusted by the number of loops of the textile material strand around the wire or tube. It increases as the numbers of loops increases. Preferably, the friction should be adjusted to and maintained at a value at least 20% higher than the tension in the strand.

The drive speed of the textile or textile material strand should clearly be slower than that of the wire or tube to be cleaned.

In a further aspect, the invention also concerns a process for cleaning a wire or the outer surface of a tube using one or more textile or textile-like material strands running substantially parallel to but in the opposite direction to the wire or tube, which may contain at least one cleaning material, which material strands are in the form of at least one loop lying closely around the wire or tube, wherein the speed and the tension of the textile or textile-like material strands is adjusted and regulated. Preferably, the cleaning material is at least one solvent and/or abrasive or polish, or other auxiliary material. Again, in this process the speed and the tension can be substantially independently adjusted and regulated, and are held substantially constant. Otherwise, the features of the process can be understood from those of the device.

In certain cases, it is preferable for cleaning to be preceded or followed by coating the wire or tube, whereupon the wire or tube and the textile or textile-like material strand run in the same direction, wherein a liquid and/or solid material in or on the material strands is deposited onto the wire. This is carried out using an apparatus which is placed upstream or downstream of the cleaning device, which in principle has the same features as the device of the present invention, but the material strand and wire/tube run in the same direction and not in opposite directions. By this adaptation of the features of the process, this treatment with a similar construction, and preferably carried out upstream, can coat the wire with an abrasive or other auxiliary material. When the apparatus is downstream, the wire can be coated with a liquid or solid lubricant and/or liquid or solid protective material.

The drawing shows a process of the invention depicted as a flow diagram.

It shows the path of a textile strand and wire as a flow chart.

In the filament take-off 4, a textile strand is pulled off one or more supply reels 4.1 and fed over the brake 4.2 on the motor unit to the strand tension regulator 2. Here, the strand is guided over a deflection roller 2.7 onto the drive roller 2.2 and, to prevent slippage, it is wound several times around it and the set of rollers 2.3.

The drive roller and set of rollers constitute a mechanical entity in the form of a dancer roll working against the spring 2.5. Displacement thereof is detected by the sensor 2.6 as the strand tension. The actual strand tension value is compared with the reference value which is set by the user. If the actual value is too high or too low, the rotational speed of the drive motor 2.1 is raised or reduced.

Next, the strand is guided over the strand payoff roll 3.2 at a low angle parallel to the wire into the looping zone 3. The wire runs between the guide rollers 3.4 and 3.5 against the direction of motion of the strand. When guided around the strand deflection rollers 3.1.1, rotating the looping unit 3.1 allows the strand to be looped around the wire on both sides of the loop unit. As the number of loops is increased, the friction between the strand and the wire increases from the tension set by the user. At the strand layoff roll 3.3, the used strand is guided away from the wire once again at a low angle and guided to the motor unit 1 regulating the speed of the strand. Again, to prevent slippage, the strand is fed several times around a drive roller 1.2 and a set of rollers 1.3. The synchronous motor 1.1 drives the strand at the speed set by the user at the control box.

The drive roller and set of rollers constitute a mechanical unit in the form of a dancer roll working against the spring 1.5. Displacement thereof is detected by a sensor 1.6 as the strand tension after the looping zone. In the main unit 5, this is compared with a user-adjustable multiple of the strand tension and evaluated for sounding a fault alarm.

Next, the strand passes over a deflection roller 1.7 to the take-up dancer unit 5.1, which switches the motor 5.8 for the take-up reel 5.9 on and off to maintain a near constant strand tension. A motor-driven laying-up mechanism 5.5 and 5.7 distributes the strand evenly over the width of the take-up reel 5.9.

What is claimed is:

1. A process for cleaning a wire or the outer surface of a tube using at least one textile or textile-like material strand that runs substantially parallel to and in contact with the wire or tube, but opposite a direction of travel of the wire or tube, and that is arranged to run in the form of at least one loop lying on the wire or tube in a looping zone, wherein the speed and the tension of the strand is adjusted and regulated and tension is adjusted and regulated prior to contact with the wire or tube.

2. A process according to claim 1 wherein the strand is a braid.

3. A process according to claim 2 wherein the strand is a strip braid or flat braid formed from 3 to 51 individual strands or a square braid or round braid formed from 4 to 32 individual strands.

4. A process according to claim 1 wherein the strand is a strip braid or flat braid with a width of 0.5 to 50 mm.

5. A process according to one claim 1 wherein the strand is a square braid or round braid with a width of 0.5 to 30 mm.

6. A process according to claim 1 wherein a coating of the wire or tube is undertaken upstream or downstream of cleaning, in which the wire or tube and a coating strand run in the same direction, whereby a liquid or solid material is transferred onto the wire or tube from the coating strand.

7. A process according to claim 1 wherein solvent, abrasive and/or polish is used as a cleaning material.

8. A process according to one of claim 1 wherein at least one of the tension and the speed of the strands is kept substantially constant.

9. A process according to claim 1 wherein the speed and the tension are adjusted and regulated substantially independently of each other.

10. A process according to claim 1 wherein a motor with a high braking torque is used for adjusting and regulating speed of the strand.

11. A process according to claim 10 wherein the motor is a permanent-magnet synchronous motor.

12. A process according to claim 1 wherein difference in strand tension before and after the looping zone is measured in order to adjust and regulate friction.

13. A process according to claim 1 wherein a cleaning material is applied prior to cleaning using a coating apparatus, which cleaning material is then removed from the wire or tube surface together with contaminants by subsequent cleaning.

14. A process according to claim 1 wherein at least one coating material is applied by a coating device after cleaning.

15. The process of claim 14 wherein the coating material is a lubricant or protective substance.

16. A device for practicing the process of claim 1 for cleaning a wire or the outer surface of a tube comprising at least one textile or textile-like material strand that runs substantially parallel to and in contact with the wire or tube, but opposite a direction of travel of the wire or tube, and that is arranged to run in the form of at least one loop in a looping zone lying on the wire or tube, wherein the device further comprises apparatus for adjusting and regulating speed and the tension of the strand and the apparatus for adjusting tension of the strand is located prior to contact with the wire or tube.

17. A device according to claim 16 wherein the strand is a braided strand selected from the group consisting of square braids, round braids, strip braids and flat braids.

18. A device according to claim 17 wherein the strand is a strip braid or flat braid formed from 3 to 51 individual strands or a square braid or a round braid formed from 4 to 32 individual strands.

19. A device according to claim 17 wherein the strand is a strip braid or flat braid with a width of 2 to 30 mm, or a square braid or round braid with a strand diameter of 1 to 10 mm.

20. A device according to claim 16 wherein the apparatus for adjusting and regulating the speed and the tension of the strand permits independent adjustment and regulation of speed and tension.

21. A device according to claim 16 wherein the device has a motor with a high braking torque for adjusting and regulating speed of the strand.

22. The device of claim 21 wherein the motor is a permanent-magnet synchronous motor.

23. The device of claim 16 comprising an apparatus for adjusting and regulating friction of the strand, wherein the apparatus for adjusting and regulating the friction of the strand adjusts to between 0.2 to 10 times a value of strand tension.

24. The device of claim 16 comprising an apparatus for adjusting and regulating friction of the strand wherein the apparatus for adjusting and regulating friction of the strand measures a difference in strand tension before and after the looping zone.

25. The device according to claim 16 wherein the number of loops in the looping zone is automatically regulated.

26. The device of claim 16 comprising an apparatus for driving the strand at a lower speed than speed of the wire or tube to be cleaned.

27. The device of claim 16 wherein the strand contains a cleaning material.

28. The device of claim 27 wherein the cleaning material is selected from the group consisting of solvent, abrasive and polish.

29. The device of claim 16 wherein a coating device is provided at at least one of an upstream or downstream position from the looping zone and a material strand within the coating device contains a coating material and runs in the same direction as the wire or tube.

30. The device of claim 29 wherein at least one material strand of the coating device contains a cleaning material in the form of a solvent and/or an abrasive or polish or a lubricant or other auxiliary material.

31. The device according to claim 16 wherein approach and exit angles of the strand to the wire or tube are in the range of about 0.2° to about 12°.

32. The device of claim 16 further comprising an apparatus for automatically holding drive speed of the strand substantially constant at constant wire or tube speed and for adjusting drive speed of the strand due to varying wire or tube speeds.

* * * * *